US010730322B2

(12) United States Patent
Moriya

(10) Patent No.: US 10,730,322 B2
(45) Date of Patent: Aug. 4, 2020

(54) MEDIUM TRANSPORT APPARATUS AND PRINTING APPARATUS

(71) Applicant: SEIKO EPSON CORPORATION, Tokyo (JP)

(72) Inventor: Yuki Moriya, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/438,726

(22) Filed: Jun. 12, 2019

(65) Prior Publication Data

US 2019/0381815 A1 Dec. 19, 2019

(30) Foreign Application Priority Data

Jun. 15, 2018 (JP) ..... 2018-114392

(51) Int. Cl.

| | |
|---|---|
| ***B41J 13/076*** | (2006.01) |
| ***B41J 13/03*** | (2006.01) |
| ***B41J 2/045*** | (2006.01) |
| ***B65H 5/06*** | (2006.01) |

(52) U.S. Cl.

CPC ..... *B41J 13/076* (2013.01); *B41J 2/04581* (2013.01); *B41J 13/03* (2013.01); *B65H 5/062* (2013.01); *B65H 2404/15* (2013.01)

(58) Field of Classification Search

CPC ..... B41J 13/076; B41J 2/04581; B41J 13/03; B41J 15/04; B65H 5/062; B65H 2404/15; B65H 27/00; B65H 2402/32; B65H 2404/17

See application file for complete search history.

(56) References Cited

U.S. PATENT DOCUMENTS

| | | | | |
|---|---|---|---|---|
| 5,965,862 | A * | 10/1999 | Momose | B41J 3/44 235/439 |
| 8,925,432 | B2 * | 1/2015 | Eoka et al. | B41J 13/10 |
| 10,577,210 | B2 * | 3/2020 | Inoue | B65H 20/36 |
| 2013/0241142 | A1 | 9/2013 | Hashiuchi | |
| 2016/0067986 | A1 * | 3/2016 | Ishikawa | B65H 20/02 347/104 |

FOREIGN PATENT DOCUMENTS

JP 2013-193306 A 9/2013

* cited by examiner

*Primary Examiner* — Henok D Legesse

(74) *Attorney, Agent, or Firm* — Workman Nydegger

(57) ABSTRACT

A medium transport apparatus includes a transport roller configured to transport a medium and a roller support portion configured to support the transport roller. The roller support portion includes a support member contacting an outer circumferential surface of the transport roller at two positions thereof in a circumferential direction to support the transport roller, a base member defining a position of the support member, and an intermediary member mediating the support member and the base member. The intermediary member is configured to cause separation between the support member and the base member without moving the support member and the base member.

8 Claims, 11 Drawing Sheets

MEDIUM TRANSPORT APPARATUS AND PRINTING APPARATUS

The present application is based on and claims priority from JP Application Serial Number 2018-114392, filed Jun. 15, 2018, the disclosure of which is hereby incorporated by reference herein in its entirety.

BACKGROUND

1. Technical Field

The present disclosure relates to a medium transport apparatus including a transport roller for transporting a medium, and a printing apparatus including the medium transport apparatus.

2. Related Art

As an example of a printing apparatus, there is known an ink jet type printer which discharges a liquid toward a medium to print an image or the like on the medium. The ink jet type printer includes a liquid discharge apparatus which discharges the liquid to the medium and a medium transport apparatus which transports the medium, and alternately repeats a discharge operation and a transport operation.

In addition, the medium transport apparatus includes a transport roller for transporting the medium, and is configured such that contact between the transport roller and the medium is maintained. For example, JP-A-2013-193306 describes a transport apparatus including a transport roller and a bearing for supporting the transport roller. The bearing includes a bearing main body, a wedge body for adjusting the height position of the bearing main body, and a bracket for attaching the bearing main body so that the position of the bearing main body may be changed in the transport direction of the medium. According to this configuration, by adjusting the position of the bearing provided in the middle of the transport roller, the bearing may be installed and adjusted to maintain the straightness of the transport roller in the transport apparatus handling a wide width medium.

However, in the transport apparatus described in JP-A-2013-193306, there has been a problem that the bearing mounting position must be adjusted by the wedge body and the bracket each time the bearing supporting the transport roller is detached or attached during maintenance that is due to deterioration of the transport roller or the bearing. The frequency of detachment/attachment and replacement of the bearing tends to increase due to an increase in the length of the transport roller corresponding to an enlargement of the medium and to an increase in the need for long-term continuous operation of equipment provided with the transport apparatus. Therefore, it is required that the bearing can be replaced more easily.

SUMMARY

A medium transport apparatus of the present application includes a transport roller configured to transport a medium, and a support portion configured to support the transport roller. The support portion includes a support member contacting an outer circumferential surface of the transport roller at two positions thereof in a circumferential direction to support the transport roller, a base member defining a position of the support member, and an intermediary member mediating the support member and the base member. The intermediary member is configured to cause separation between the support member and the base member without moving the support member and the base member.

In the medium transporting apparatus described above, the support member and the intermediary member may have a first regulating structure configured to regulate a mutual position thereof, and the intermediary member and the base member may have a second regulating structure configured to regulate a mutual position thereof.

In the medium transport apparatus described above, the intermediary member may be configured to be separated from the support member and the base member by moving along the predetermined direction, and the first regulating structure and the second regulating structure may regulate positions in a direction intersecting the predetermined direction.

In the medium transport apparatus described above, the support member and the base member preferably include a third regulating structure configured to regulate a mutual position thereof when the support member and the base member are stacked on each other.

In the medium transport apparatus described above, the first to third regulating structures may have a shape in common.

In the medium transport apparatus described above, at least one of the support member and the base member may include an insertion portion into which an end portion of the intermediary member in a direction opposite to the predetermined direction is inserted when the support member and the base member are stacked on each other.

In the medium transport apparatus described above, the intermediary member may include a grip portion at an end portion thereof in the predetermined direction.

The printing apparatus of the present application includes the medium transport apparatus described above.

DESCRIPTION OF EXEMPLARY EMBODIMENTS

Figure 1:
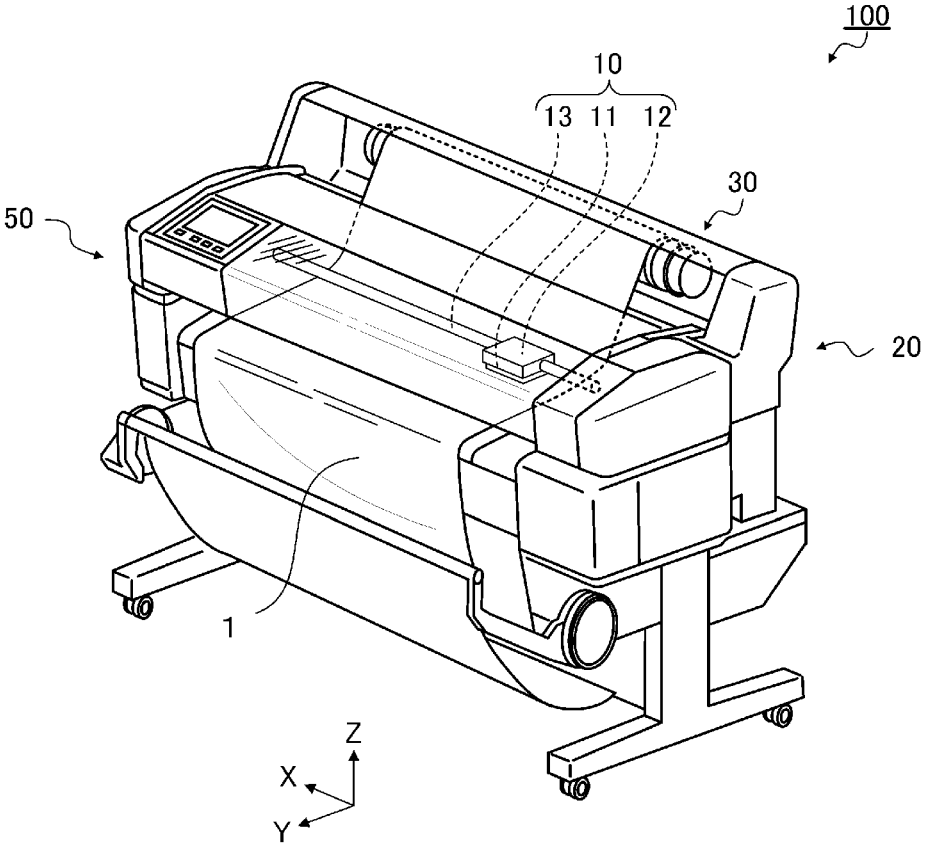
FIG. 1 is a perspective view of a printing apparatus according to Embodiment 1.

Embodiments of the present disclosure will be described below with reference to the drawings. The following is one embodiment of the present disclosure and does not limit the present disclosure. Note that the respective drawings may be illustrated not-to-scale for illustrative clarity. In addition, in the coordinates in the drawings, the Z-axis direction is the vertical direction, the +Z direction is the up direction, the a Y-axis direction is the front-rear (front-back) direction, the +Y direction is the forward (front) direction, the X-axis direction is the left-right (side) direction, the +X direction is the left direction, and the X-Y plane is the horizontal plane.

Basic Configuration of Printing Apparatus

Figure 2:
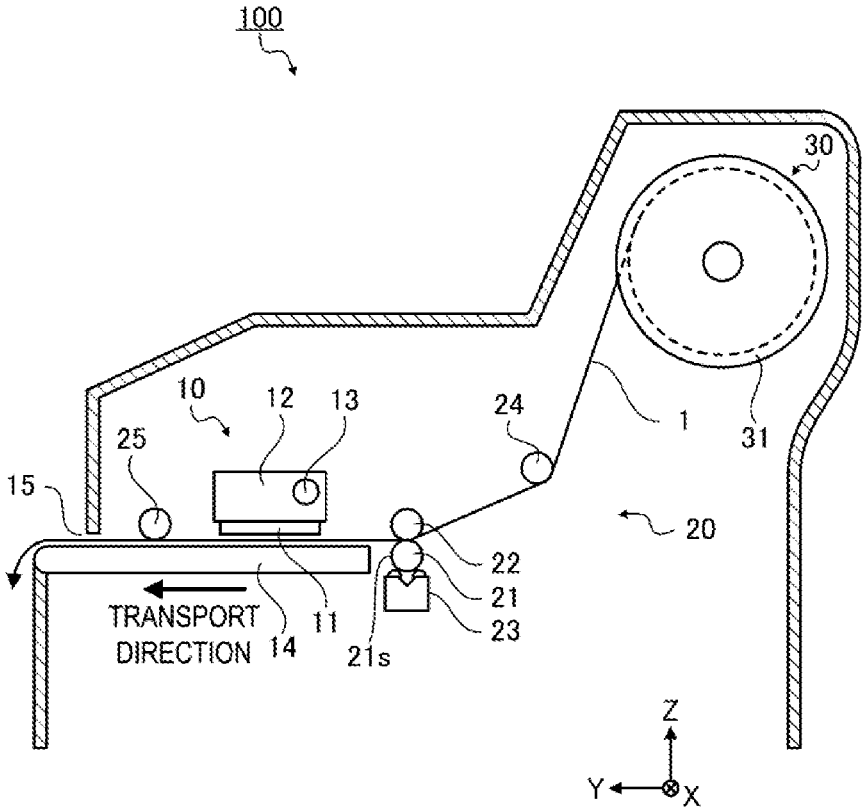
FIG. 2 is a configuration diagram of an interior of a printing apparatus as viewed from the side.

FIG. 1 is a perspective view of a printing apparatus 100 according to Embodiment 1. FIG. 2 is a configuration diagram of the interior of the printing apparatus 100 as viewed from the side.

The printing apparatus 100 is an ink jet type printer that performs printing by discharging ink droplets on a roll paper 1 as a "medium" supplied in a roll state.

The printing apparatus 100 includes a printing unit 10, a transport unit 20 as a "medium transport apparatus", a supply unit 30, a control unit 50, and the like.

The printing unit 10 includes a printing head 11, a carriage 12, a guide shaft 13, a platen 14, a carriage motor (not illustrated), and the like.

The printing head 11 includes a plurality of nozzles that discharge ink for printing as ink droplets. The printing head 11 is mounted on the carriage 12 and moves in the scanning direction along with the carriage 12 reciprocating in the scanning direction (the X-axis direction illustrated in the drawing).

The guide shaft 13 extends in the scanning direction and supports the carriage 12 in a slidable contact state. The carriage motor serves as a driving source when reciprocating the carriage 12 along the guide shaft 13.

The platen 14 is a flat plate including an air suction hole for sucking the roll paper 1 on a support surface for supporting the roll paper 1. The platen 14 is disposed opposite to the printing head 11 and spaced apart at a predetermined distance from a nozzle plate (not illustrated) on which nozzles are arranged. Further, the platen 14 extends from an area (print region), where the ink droplets are discharged from the printing head 11 and the roll paper 1 is printed, to an ejection port 15 from which the printed roll paper 1 is ejected.

According to the control of the control unit 50, the printing apparatus 100 repeatedly performs an operation of discharging ink droplets from the printing head 11 while moving the carriage 12 on which the printing head 11 is mounted along the guide shaft 13, and an operation of moving the roll paper 1 in a transport direction (the +Y direction) intersecting the scanning direction (the X-axis direction) in an area (a print region) where the ink droplets are discharged from the printing head 11 and the roll paper 1 is printed, so that a desired image is formed (printed) on the roll paper 1.

Examples of the ink include a four color ink set, as an ink set of dark ink compositions, obtained by adding black (K) to a three color ink set including cyan (C), magenta (M), and yellow (Y). Examples of the ink also include an eight color ink set obtained by adding an ink set of light ink compositions, such as light cyan (Lc), light magenta (Lm), light yellow (Ly), and light black (Lk), with reduced concentrations of the respective color materials.

A suitable example of a technique of discharging ink droplets (inkjet technique) is a piezoelectric technique. The piezoelectric technique is a method in which pressure corresponding to a print information signal is applied to ink stored in a pressure chamber by a piezoelectric element (piezo element), and ink droplets are ejected (discharged) from a nozzle communicating with the pressure chamber to perform printing.

Note that the method of discharging ink droplets is not limited to this, and other printing methods may be used in which droplets of ink are ejected in a droplet form to form a group of dots on a printing medium. For example, ink is continuously ejected from a liquid ejecting nozzle (hereinafter referred to as a nozzle) in a droplet form with a strong electric field between the nozzle and an accelerating electrode placed in front of the nozzle, and a print information signal is given from a deflection electrode while the ink droplet flies to perform printing. In addition, a method such as a method in which ink droplets are ejected corresponding to a print information signal without deflection (an electrostatic attraction method), a method of forcibly ejecting ink droplets by applying a pressure to ink with a small pump and mechanically vibrating a nozzle using a crystal vibrator or the like, and a method of heating and foaming the ink with a microelectrode according to a print information signal and ejecting ink droplets to perform printing (thermal jet method), may be used.

The supply unit 30 includes a roll paper storage unit 31 which rotatably holds a roll paper 1 in a roll shape, and supplies the roll paper 1 accommodated therein to the printing unit 10 in accordance with driving of the transport unit 20.

The transport unit 20 includes a transport roller 21, a press roller 22, a roller support portion 23 as a "support portion", a guide roller 24, an ejection roller 25, and the like, which form a transport path for moving and transporting the roll paper 1 from the supply unit 30 to the printing unit 10 and the ejection port 15 in this order.

The transport roller 21 has a shaft length longer than the width of the roll paper 1 and is a driving roller extending in the X-axis direction. The roll paper 1 is sandwiched between the transport roller 21 and the press roller 22. The transport roller 21 transmits a force in the transport direction by bringing the rotationally driven circumference of the transport roller 21 into contact with the roll paper 1, and transports the roll paper 1.

The transport roller 21 is provided on the upstream side of the printing unit 10 in the transport direction of the roll paper 1, together with the press roller 22, the roller support portion 23, and a driving motor (not illustrated) for rotationally driving the transport roller 21.

The press roller 22 has a shaft length longer than the width of the roll paper 1 and is a driven roller extending in the X-axis direction. The press roller 22 is disposed on an upper side of the transport roller 21, and sandwiches the roll paper 1 from the upper side between the press roller 22 and the transport roller 21, and is driven to rotate with the rotation (the movement of the roll paper 1) of the transport roller 21 while pressing the transport roller 21 (the roll paper 1).

The roller support portion 23 is configured to support the transport roller 21 pressed by the press roller 22 by coming into contact with the transport roller 21 from the lower side of the transport roller 21. For example, one roller support portion 23 is provided in the X-axis direction in the central region of the transport roller 21 extending in the X-axis direction, or when the length of the transport roller 21 is long, a plurality of the roller support portions 23 are provided at predetermined intervals. The configuration of the roller support portion 23 will be described later.

The guide roller 24 is a driven roller forming a transport path for guiding the roll paper 1 from the supply unit 30 to the transport roller 21.

The ejection roller 25 is a driven roller which constitutes a transport path for guiding the roll paper 1 from the print region to the ejection port 15. Further, it should be noted that the ejection roller 25 may be a driving roller for applying a predetermined tension to the roll paper 1 in the print region and transmitting the force so as to send it out to the ejection port 15.

The control unit 50 includes a CPU (arithmetic unit), a storage medium (not illustrated) such as a RAM and a ROM, and performs centralized control of the entire printing apparatus 100. Specifically, the control unit 50 controls the printing unit 10, the transport unit 20, the supply unit 30, and the like based on image data and printing specifications received from an external electronic device such as a personal computer or an external storage medium, forming a desired print image in the roll paper 1 to create a printed matter.

In the present embodiment, as the printing head 11, a serial head type which discharges ink while reciprocating in the width direction (the X-axis direction) of the roll paper 1 mounted on the carriage 12 has been exemplified, but the printing head may be a line head type which extends in the width direction (the X-axis direction) of the roll paper 1 and is fixed.

Configuration of Support Portion (Roller Support Portion 23)

Figure 3:
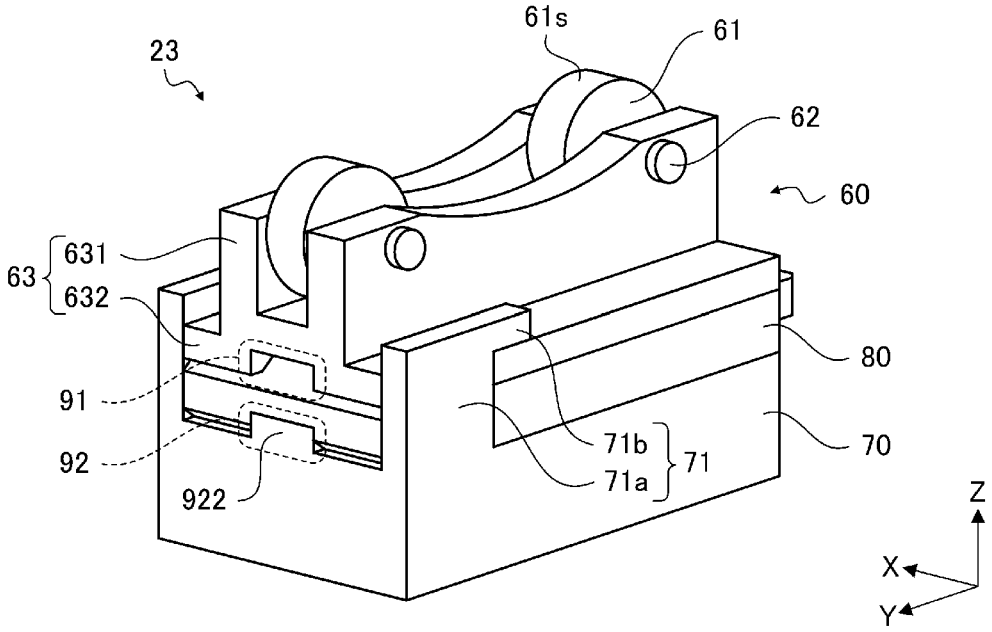
FIG. 3 is a perspective view illustrating a configuration of a roller support portion as a "support portion".
Figure 4:
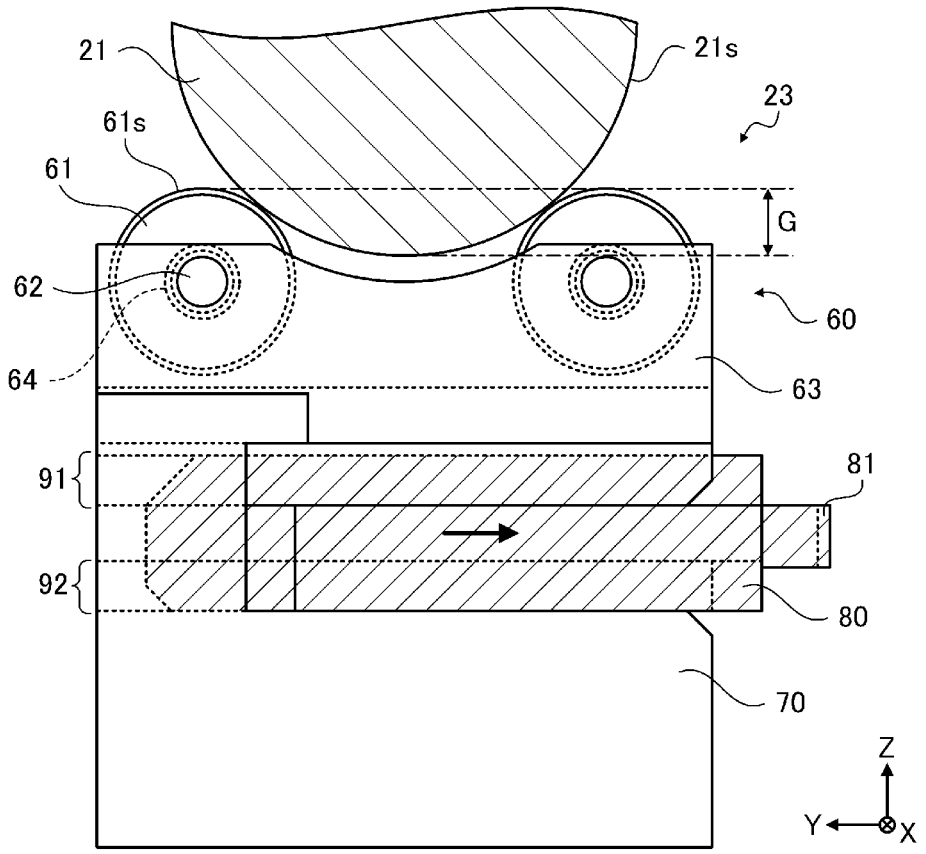
FIG. 4 is a side view illustrating a configuration of a roller support portion.

FIG. 3 is a perspective view illustrating the configuration of the roller support portion 23, and FIG. 4 is a side view thereof.

The roller support portion 23 as the "support portion" in the present embodiment includes a support member 60 which contacts the outer circumferential surface 21*s* (refer to FIG. 4) of the transport roller 21 at two positions in the circumferential direction and supports the transport roller 21, a base member 70 which defines the mounting position of the roller support portion 23, and an intermediary member 80 which mediates the support member 60 and the base member 70. The base member 70, the intermediary member 80, and the support member 60 are separable from each other, and in a use state of the printing apparatus 100, the base member 70, the intermediary member 80, and the support member 60 are stacked in this order from the bottom.

In addition, the support member 60 and the intermediary member 80 include a first regulating structure 91 for regulating the mutual position when they are stacked on each other, and the intermediary member 80 and the base member 70 include a second regulating structure 92 for regulating the mutual position when they are stacked.

In the use state of the printing apparatus 100, in order to prevent the intermediary member 80 and the support member 60 from moving in a direction other than the direction in which the first regulating structure 91 and the second regulating structure 92 regulate, the stacked structure of the base member 70, the intermediary member 80, and the support member 60 may be screwed with a fixing plate (not illustrated) or the like.

The support member 60 includes two bearings 61, two rotary shaft rods 62, a support block 63, and the like.

The bearing 61 is a bearing having a bearing structure composed of an outer ring, an inner ring, and a spherical rolling element sandwiched between the outer ring and the inner ring, and supports the transport roller 21 pressed by the press roller 22 by means of the outer ring coming into contact with the transport roller 21 from the lower side. That is, in the roller support portion 23, the two bearings 61 comes in contact with the outer circumferential surface 21*s* of the transport roller 21 at two positions in the circumferential direction to support the transport roller 21.

The rotary shaft rod 62 fixes the inner ring of the bearing 61 and constitutes the rotary shaft of the bearing 61.

The support block 63 is a block body composed of the support wall 631 and the bottom portion 632, and is positioned by the base member 70 via the intermediary member 80.

The support wall 631 is a body of two block walls which stand upright in the +Z direction from the bottom portion 632 and extend parallel to the Y-axis direction, and fixedly supports the rotary shaft rod 62 at both end portions thereof.

The bottom portion 632 is a base block body which forms the bottom portion of the support block 63, and the bottom surface of the bottom portion 632 is formed to be a plane parallel to the X-Y plane when the base member 70, the intermediary member 80, and the support member 60 are stacked in a use state of the printing apparatus 100.

One of the two rotary shaft rods 62 is disposed on the +Y side away from the axis of the transport roller 21 such that the outer circumferential surface 61*s* of one of the two bearings 61 under the transport rollers 21 comes into contact with an outer circumferential surface 21*s* of the transport roller 21. The other of the two rotary shaft rods 62 is disposed on the −Y side away from the axis of the transport roller 21 such that the outer circumferential surface 61*s* of one of the two bearings 61 under the transport rollers 21 comes into contact with an outer circumferential surface 21*s* of the transport roller 21, in parallel with the axial direction of the one of the rotary shaft rods 62.

Further, here, the term "parallel" is not limited to a parallel state in a strict sense, but includes a state in which an object is arranged so as to be parallel (a state including an error due to manufacturing accuracy variation).

Figure 5:
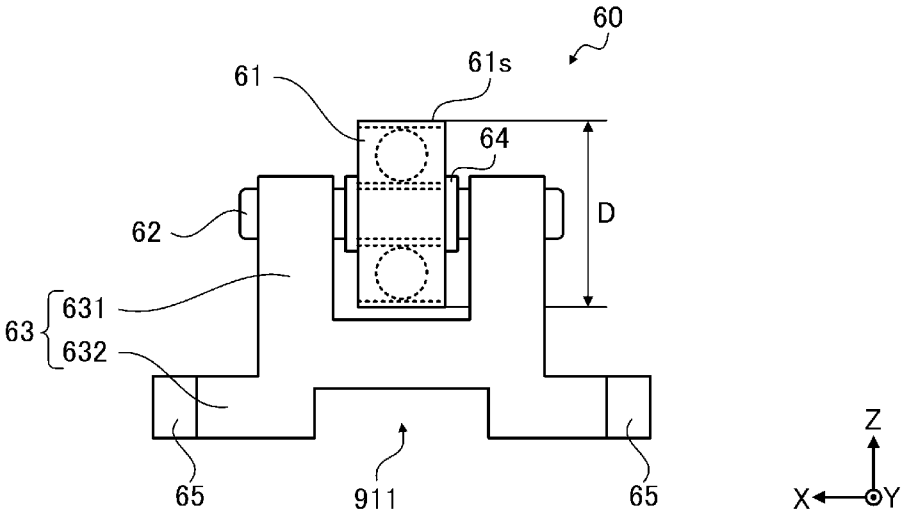
FIG. 5 is a front view illustrating a configuration of a support member.

FIG. 5 is a front view illustrating the configuration of the support member 60.

A stopper 64 is provided between the bearing 61 and the inner wall of the support wall 631 supporting the rotary shaft rod 62, as illustrated in FIG. 5, to prevent the movement of the bearing 61 in the X-axis direction or the contact of the inner wall of the support wall 631 with the side surface of the bearing 61.

In the central region (the central region in the X-axis direction) of the bottom portion (the bottom portion 632) of the support block 63, a groove 911 that opens in the −Z direction and extends over the entire length in the Y-axis direction of the support block 63 is formed. The groove 911 forms a first regulating structure 91 together with a rib 912 described later.

In addition, a concave portion 65 to be engaged with a hold portion 71 (hold wall 71*a*, refer to FIG. 3) of the base member 70 to be described later is formed at both left-right end portions on the +Y side of the bottom portion 632.

The description will be continued with reference to FIGS. 3 and 4.

The base member 70 is a base member that determines the mounting position of the roller support portion 23, and is fixed to a main body frame (not illustrated) on which the guide shaft 13 and the platen 14 are fixedly supported. When the base member 70 is fixed to a main body frame (not illustrated) of the printing apparatus 100 installed on the X-Y plane, the upper surface of the base member 70 is formed to be a plane parallel to the X-Y plane. Further, the base member 70 defines the position where the support member 60 is installed via the intermediary member 80 stacked on the upper surface of the base member 70, and is fixed such that the axial direction of the rotary shaft rod 62 of the support member 60 is located in the X-axis direction.

The base member 70 includes a hold portion 71 for regulating the support member 60 and the intermediary member 80 from jumping out in the +Y direction or the +Z direction at the time of installation or use.

In the left-right end regions on the +Y side of the base member 70, the hold portion 71 includes a hold wall 71*a* extending in the +Z direction from the upper surface thereof, an overhang portion 71*b* projecting in the −Y direction at the upper end portion of the hold wall 71*a*.

The hold wall 71*a* is fitted to a concave portion 65 (refer to FIG. 5) provided at the left-right end portions of the bottom portion (bottom portion 632) of the support member 60 on the +Y side, and is fitted to a concave portion 85 (refer to FIG. 6) provided at the left-right end portions of the intermediary member 80 on the +Y side, and regulates the protrusion of the support member 60 and the intermediary member 80 in the +Y direction.

The overhang portion 71*b* is provided so as to overhang on both the left-right end regions on the +Y side of the support member 60 (the bottom portion 632) when the base member 70, the intermediary member 80, and the support member 60 are stacked, which restricts the movement of the support member 60 and the intermediary member 80 in the +Z direction.

A rib 922 which protrudes and extends over the entire length of the base member 70 in the Y-axis direction is formed in the central region (the central region in the X-axis direction) of the upper surface of the base member 70. The rib 922, together with a groove 921 to be described later, constitutes the second regulating structure 92.

The intermediary member 80 is a spacer member that mediates the support member 60 and the base member 70, and the upper surface and the bottom surface of the intermediary member 80 are parallel to the X-Y plane when the base member 70, the intermediary member 80, and the support member 60 are stacked. The intermediary member 80 may separate the support member 60 and the base member 70 without moving the support member 60 and the base member 70 by being pulled out in the −Y direction serving as the "predetermined direction" from the state in which the base member 70, the intermediary member 80, and the support member 60 are stacked in this order. FIG. 4 illustrates a state in which the intermediary member 80 is slightly moved in the −Y direction.

In the present embodiment, the "predetermined direction" is described as the −Y direction, but it may be the +Y direction as long as it is easy to access the transport roller 21 and the roller support portion 23 when the maintenance thereof is performed. In that case, the installation direction of the roller support portion 23 is in the opposite direction in the Y-axis direction.

Further, the support member 60 and the base member 70 being separable without moving by the pulling out of the intermediary member 80 is not limited to the non-movement of the support member 60. In many cases, by pulling out the intermediary member 80, the support member 60 moves down due to its own weight to the space generated under the support member 60. That is, the support member 60 and the base member 70 being separable without moving by the pulling out of the intermediary member 80 means that the intermediary member 80 may be pulled out and separated without movement of the support member 60 and the base member 70.

Figure 6:
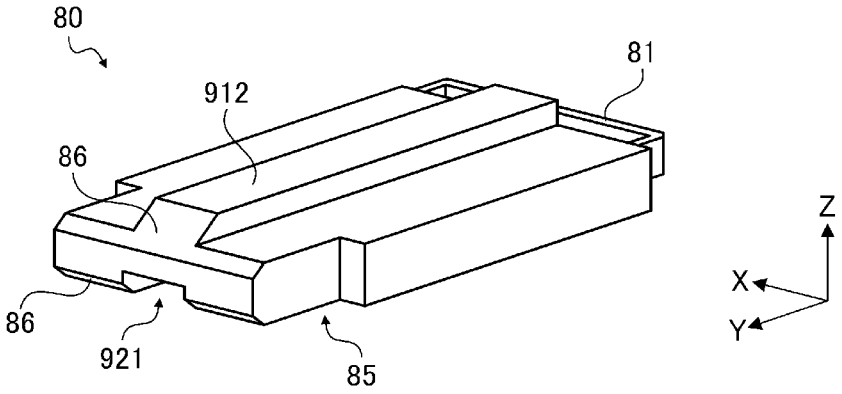
FIG. 6 is a perspective view of an intermediary member separated from a roller support portion.
Figure 7:
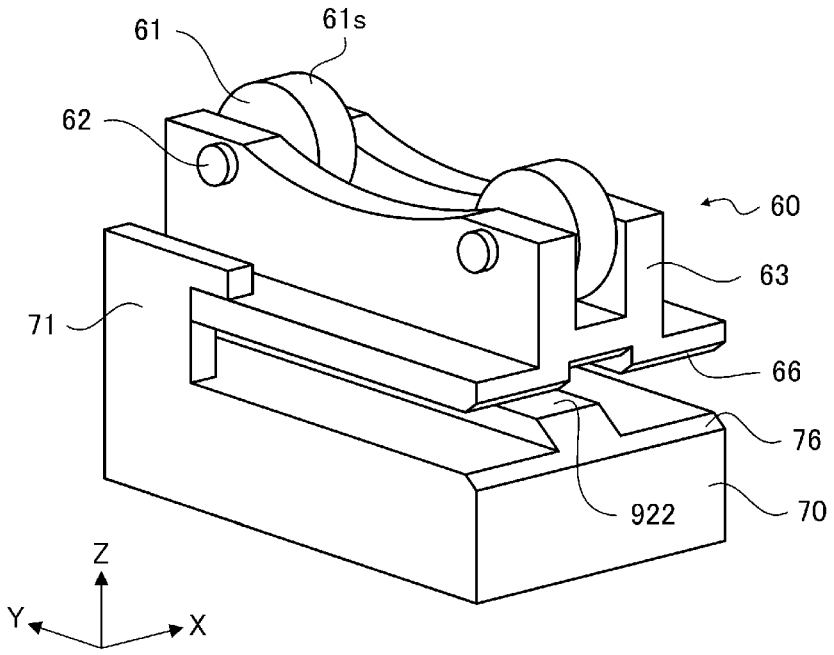
FIG. 7 is a perspective view illustrating a roller support portion in a state in which an intermediary member is separated.

FIG. 6 is a perspective view of the intermediary member 80 separated from the roller support portion 23, and FIG. 7 is a perspective view illustrating the roller support portion 23 in a state where the intermediary member 80 is separated. Note that FIG. 7 is illustrated from a direction different from the perspective view of FIG. 3 and FIG. 6. Further, when the intermediary member 80 is pulled out and the base member 70, the intermediary member 80, and the support member 60 are separated, the support member 60 may be ready to move in the direction of the base member 70 due to its own weight, but in FIG. 7, the support member 60 is illustrated in a floating state at a position before separation.

As illustrated in FIG. 6, a rib 912 protruding and extending over the entire length of the intermediary member 80 in the Y-axis direction is formed in the central region (the central region in the X-axis direction) of the upper surface of the intermediary member 80. The rib 912, together with the groove 911, constitutes a first regulating structure 91. Further, a groove 921 which opens in the −Z direction and extends over the entire length in the Y-axis direction of the intermediary member 80 is formed in the central region (central region in the X-axis direction) of the bottom surface of the intermediary member 80. The groove 921, together with the rib 922, constitutes the second regulating structure 92.

Further, a grip portion 81 is provided on the back surface on the −Y side of the intermediary member 80 (the end portion in the "predetermined direction") to facilitate pulling out of the intermediary member 80 in the −Y direction.

In addition, a concave portion 85 to be fitted to the hold portion 71 (hold wall 71*a*, refer to FIG. 3) of the base member 70 is formed at both left-right end portions on the +Y side of the intermediary member 80.

Further, as illustrated in FIG. 6, on the upper and lower sides of the leading end portion on the +Y side of the intermediary member 80, there is provided a tapered portion 86 in order to facilitate insertion of the intermediary member 80 again, which was pulled out and separated, between the support member 60 and the base member 70.

Further, as illustrated in FIG. 7, in order to facilitate insertion of the intermediary member 80 again, which was pulled out and separated, between the support member 60 and the base member 70, a tapered portion 66 is provided at the lower portion of the −Y side end of the support member 60 (support block 63), and a tapered portion 76 is provided at the upper portion of the −Y side end of the base member 70. The space formed by providing the tapered portion 66 and the tapered portion 76 is the "inserting portion" in the present embodiment.

Note that the space as the "insertion portion" for facilitating the insertion of the intermediary member 80 is not necessarily formed by both the tapered portion 66 and the tapered portion 76. The space may be a space formed by either the tapered portion 66 or the tapered portion 76.

That is, at least one of the support member 60 and the base member 70 includes an "insertion portion" into which an end portion of the intermediary member 80 in the direction opposite to the −Y direction (predetermined direction) is inserted when the support member 60 and the base member 70 are stacked on each other.

Figure 8:
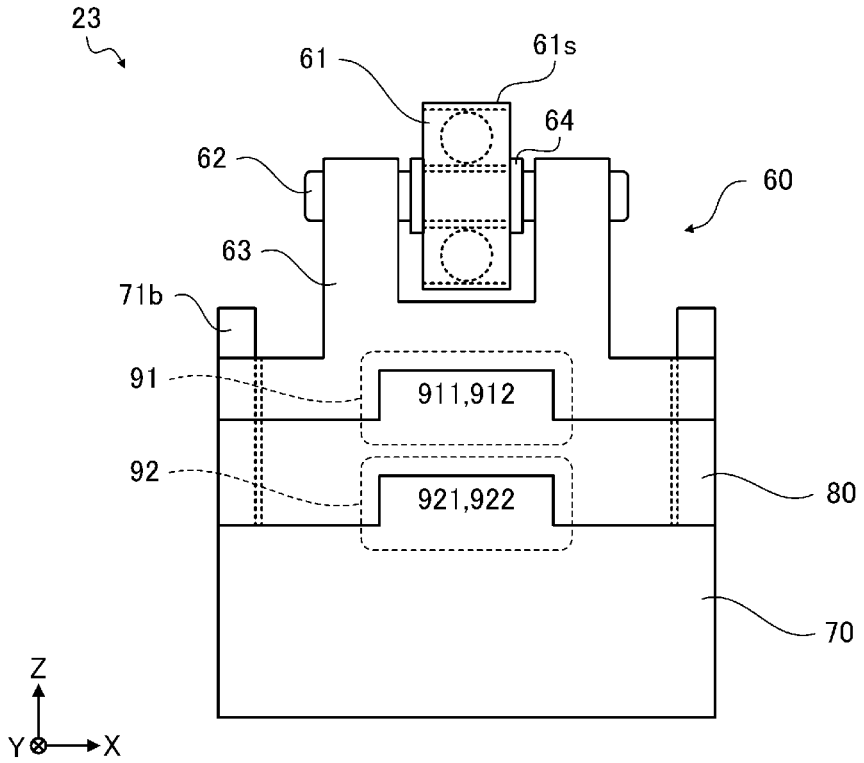
FIG. 8 is a rear view of a roller support portion.

FIG. 8 is a rear view of the roller support portion 23, illustrating the structures of the first regulating structure 91 and the second regulating structure 92, and their respective relationship. In FIG. 8, illustration of the grip portion 81, the tapered portion 66, and the tapered portion 76 is omitted.

The first regulating structure 91 includes a groove 911 formed in the bottom portion (the bottom portion 632) of the support member 60, and a rib 912, formed on an upper surface of the intermediary member 80, which fits into the groove 911 when the support member 60 and the intermediary member 80 are stacked. The groove 911 and the rib 912 extend in the Y-axis direction respectively, and regulate the position of the support member 60 with respect to the intermediary member 80 (the position in the X-axis direction intersecting the Y-axis direction (movement in the X direction)).

The second regulating structure 92 includes a groove 921 formed in the bottom surface of the intermediary member 80, and a rib 922, formed on an upper surface of the base member 70, which fits into the groove 921 when the intermediary member 80 and the base member 70 are stacked. The groove 921 and the rib 922 extend in the Y-axis direction respectively, and regulate the position of the intermediary member 80 with respect to the base member 70 (the position in the X-axis direction intersecting the Y-axis direction).

That is, the base member 70 is configured to define the position (position in the X-axis direction and in the Z-axis direction) of the support member 60 via the intermediary member 80. Further, by moving the intermediary member 80 in the −Y direction without moving the support member 60 and the base member 70, each of the support member 60 and the base member 70 may be separated.

Further, in the present embodiment, the groove 911 and the groove 921 are formed in the same shape at the same position on the X-axis (the same position on the X-axis when the support member 60 and the intermediary member 80 are stacked). The rib 912 and the rib 922 are also formed in the same shape at the same position on the X-axis (the same position on the X-axis when the intermediary member 80 and the base member 70 are stacked).

With such a configuration, when the intermediary member 80 is separated, the descending support member 60 and the base member 70 may be overlapped and the rib 922 may be fitted in the groove 911. The fitting of the groove 911 and the rib 922 may be configured as a "third regulating structure" which regulates the position of the support member 60 (position in the X-axis direction) relative to the position of the base member 70.

That is, the support member 60 and the base member 70 include the third regulating structure for regulating the mutual position when they are stacked on each other. In addition, the first to third regulating structures have a shape in common.

As a material constituting the support block 63, the base member 70, and the intermediary member 80, a polyacetal resin is used as a suitable example. Note that the materials constituting these materials are not limited to a resin such as polyacetal.

The thickness (the length that allows the support member 60 to move in the −Z direction by separating the intermediary member 80) of the intermediary member 80 may be larger than the length G (the gap in the Z-axis direction between the lowermost point of the outer circumferential surface 21*s* of the transport roller 21 and the uppermost point of the outer circumferential surface 61*s* of the bearing 61) illustrated in FIG. 4.

As described above, according to the medium transport apparatus and the printing apparatus of the present embodiment, the following effects may be obtained.

The roller support portion 23 supporting the transport roller 21 includes a support member 60 which contacts the outer circumferential surface 21*s* of the transport roller 21 at two positions in the circumferential direction and supports the transport roller 21, a base member 70 which defines the position of the support member 60, and an intermediary member 80 which mediates the support member 60 and the base member 70. The intermediary member 80 may separate the support member 60 and the base member 70 without moving the support member 60 and the base member 70. In other words, since the roller support portion 23 supporting the transport roller 21 has a separated structure in which the intermediary member 80 is interposed, by moving the intermediary member 80 without moving the support member 60 supporting the transport roller 21 and the base member 70 defining the position of the support member 60, the support member 60 and the base member 70 may be separated.

Further, by moving the intermediary member 80 to separate the support member 60 and the base member 70, the support member 60 may be easily removed and replaced by utilizing the space resulting from the separation of the intermediary member 80. Specifically, since the support member 60 is configured to contact and support the outer circumferential surface 21*s* of the transport roller 21 at two positions in the circumferential direction, the support member 60 may not be caused to move (without moving the transport roller 21) in the straight line direction connecting the contact points which contact with the outer circumferential surface 21*s*. On the other hand, since the support member 60 may be moved in the direction of the space resulting from the separation of the intermediary member 80, the support member 60 may be more easily removed and replaced. In particular, when the thickness (the length that allows the support member 60 to move in the −Z direction by separating the intermediary member 80) of the intermediary member 80 is configured to be thicker (longer) than the gap in the Z-axis direction between the lowermost point of the outer circumferential surface 21*s* of the transport roller 21 and the uppermost point of the outer circumferential surface 61*s* of the bearing 61, the support member 60 may be removed and replaced without bending or moving the transport roller 21.

When mounting the support member 60 again, firstly, the support member 60 is brought into contact with the transport roller 21 from the space resulting from the separation of the intermediary member 80, and then the intermediary member 80 is returned to the original position (the original position in the positional relationship with each of the support member 60 and the base member 70), so that the mounting of the support member 60 is completed. In the configuration in which the intermediary member 80 is stacked between the support member 60 and the base member 70 in the height direction, by inserting and returning the intermediary member 80 between the support member 60 and the base member 70, the positional relationship between the support member 60 and the base member 70 in the height direction may be reproduced.

In addition, the support member 60 and the intermediary member 80 include a first regulating structure 91 for regulating the mutual position, and the intermediary member 80 and the base member 70 include a second regulating structure 92 for regulating the mutual position. That is, the position of the support member 60 supporting the transport roller 21 is defined by the base member 70 defining the position of the support member 60 via the intermediary member 80 (via the first regulating structure 91 and the second regulating structure 92). Specifically, in the configuration in which the intermediary member 80 is stacked between the support member 60 and the base member 70 in the height direction, by inserting and returning the intermediary member 80 between the support member 60 and the base member 70, the position in the left-right direction (X-axis direction) defined via the first regulating structure 91 and the second regulating structure 92, in addition to the positional relationship in the height direction (Z-axis direction) between the support member 60 and the base member 70, may be reproduced. That is, the support member 60 is not required for adjustment of the position thereof each time the support member 60 is exchanged.

In addition, the intermediary member 80 may be separated from the support member 60 and the base member 70 by moving along the Y-axis direction (−Y direction), and the first regulating structure 91 and the second regulating structure 92 regulate the position in the X-axis direction intersecting the Y-axis direction. The direction regulated by the first regulating structure 91, which regulates the positional relationship between the support member 60 and the intermediary member 80, and the second regulating structure 92, which regulates the positional relationship between the intermediary member 80 and the base member 70, is a direction intersecting the −Y direction in which the intermediary member 80 is moved to be separated from the support member 60 and the base member 70. Therefore, the first regulating structure 91 and the second regulating structure 92 do not interfere with the movement of the intermediary member 80 from the support member 60 and the base member 70, so that the support member 60, the base member 70, and the intermediary member 80 may be easily separated.

In addition, the support member 60 and the base member 70 include a third regulating structure for regulating the mutual position when the support member 60 and the base member 70 are stacked on each other. In other words, when the intermediary member 80 is separated from the support member 60 and the base member 70, and the support member 60 descends as a result and stacks on the base member 70, the movement of the support member 60 in the X-axis direction, which is regulated by the third regulating structure, may be regulated with respect to the base member 70 which defines the position of the support member 60. For example, when the position, at which the support member 60 is regulated with respect to the base member 70 in the X-axis direction regulated by the first regulating structure 91 and the second regulating structure 92, is set the same as the position at which the support member 60 is regulated with respect to the base member 70 in the X-axis direction regulated by the third regulating structure, the degree of adjustment of the position of the support member 60 to the original position may be reduced when returning the intermediary member 80.

In addition, since the first regulating structure 91, the second regulating structure 92 and the third regulating structure have a common shape respectively, the regulation of the positional relationship between the support member 60 and the base member 70, the regulation of the positional relationship between the support member 60 and the intermediary member 80, and the regulation of the positional relationship between the base member 70 and the intermediary member 80, may be performed in the same manner.

By setting the dimensional position in the regulating direction of the first regulating structure 91, the second regulating structure 92, and the third regulating structure the same, the position in which the support member 60 is regulated relative to the base member 70 in the direction regulated by the first regulating structure 91 and the second regulating structure 92, and the position in which the support member 60 is regulated relative to the base member 70 in the direction regulated by the third regulating structure, may be set at the same position.

At least one of the support member 60 and the base member 70 includes an insertion portion into which the end portion in the +Y direction of the intermediary member 80 is inserted when the support member 60 and the base member 70 are stacked on each other. Therefore, when the intermediary member 80 is separated from the support member 60 and the base member 70 and is then inserted again between the support member 60 and the base member 70 to return the intermediary member 80 to the original position, these operations may be facilitated.

In addition, since the intermediary member 80 includes the grip portion 81 at the end in the −Y direction, an operation of moving the intermediary member 80 along the −Y direction and separating the intermediary member 80 from the support member 60 and the base member 70 may be facilitated.

Further, since the printing apparatus 100 includes the transport unit 20 which facilitates removal/replacement of the support member 60 for supporting the transport roller 21 transporting the roll paper 1, the reduction in productivity due to replacement of the support member 60 may be suppressed.

Note that, the present disclosure is not limited to the embodiments described above, which may be variously changed and modified. Modified examples will be described below. Further, the same constituents as those in Embodiment 1 are given the same reference signs, and redundant description of these constituents will be omitted.

Modified Example 1

Figure 9:
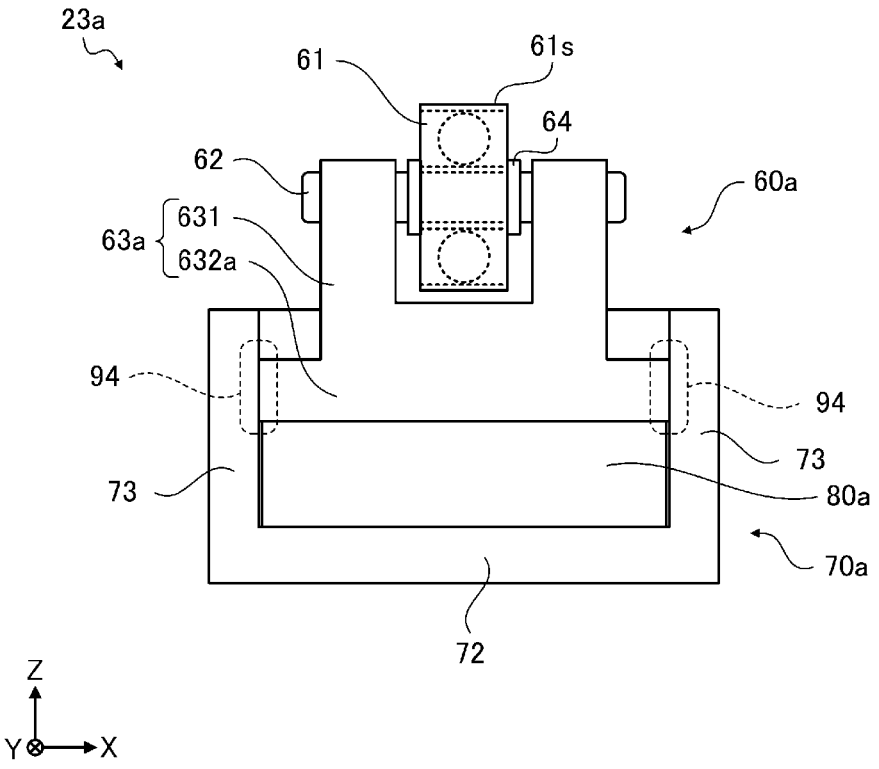
FIG. 9 is a rear view illustrating a configuration of a roller support portion as a "support portion" according to Modified Example 1.

FIG. 9 is a rear view illustrating a configuration of a roller support portion 23*a* as a "support portion" according to Modified Example 1. In FIG. 9, illustration of the grip portion 81, the tapered portion 66, and the tapered portion 76 is omitted.

In Embodiment 1, as illustrated in FIG. 8, the base member 70 has been described to be configured to define the position of the support member 60 via the intermediary member 80, but the present disclosure is not limited to this configuration. As illustrated in FIG. 9, the base member 70 may directly define the position (the position in the X-axis direction) of the support member 60.

The roller support portion 23*a* includes a support member 60*a*, a base member 70*a*, and an intermediary member 80*a* which mediates the support member 60*a* and the base member 70*a*.

The support member 60*a* includes a support block 63*a* instead of the support block 63 of Embodiment 1. Otherwise, the support member 60*a* has the same configuration as the support member 60.

The support block 63*a* is a block body composed of a support wall 631 and a bottom portion 632*a*. The bottom portion 632*a* does not include the groove 911 in its bottom portion, and its bottom surface is constructed to be flat. Otherwise, the bottom portion 632*a* has the same configuration as the bottom portion 632 of Embodiment 1.

The intermediary member 80*a* does not include the rib 912 and the groove 921, and both of the upper surface and the bottom surface of the intermediary member 80*a* are constructed to be flat. Otherwise, the intermediary member 80*a* is the same as the intermediary member 80 of Embodiment 1.

Figure 10:
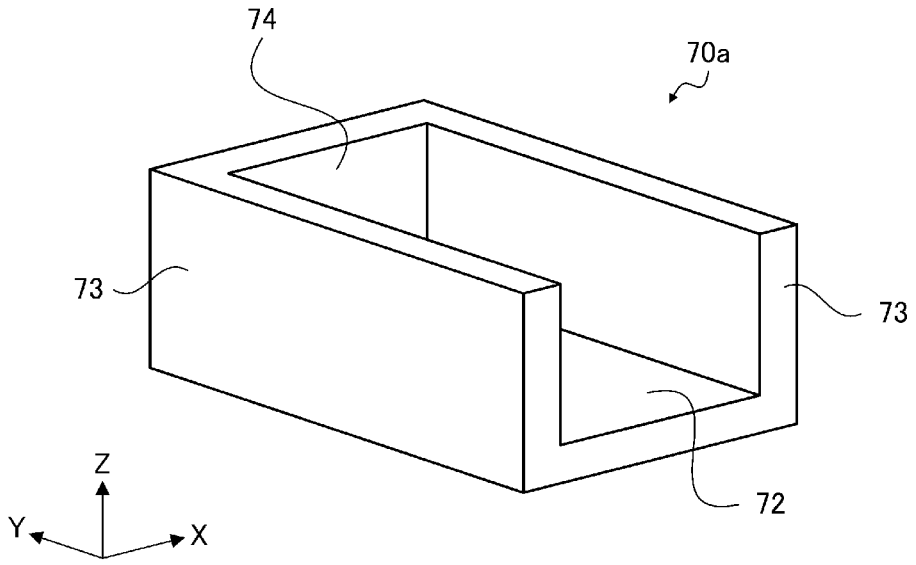
FIG. 10 is a perspective view of a base member according to Modified Example 1.

FIG. 10 is a perspective view of the base member 70*a*.

The base member 70*a* is a box body in which the side surface in the −Y direction and the top surface in the +Z direction are open, and does not include the rib 922 and the hold portion 71. The box body constituting the base member 70*a* includes a bottom portion 72 and two hold walls 73 parallel to a Y-Z plane rising in the +Z direction from the bottom portion 72 in both end regions in the X-axis direction, and a single hold wall 74 parallel to a X-Z plane rising in the +Z direction from the bottom portion 72. The upper surface of the bottom portion 72 (the surface with which the bottom surface of the intermediary member 80*a* comes into contact when the intermediary member 80*a* is stacked on the base member 70*a*) is formed so as to be a plane parallel to the X-Y plane when the base member 70*a* is fixed to the main body frame of the printing apparatus 100 (not illustrated) which is installed in the X-Y plane.

In the use state of the printing apparatus 100, as illustrated in FIG. 9, the intermediary member 80*a* and the lower region (the region including the bottom portion 632*a*) of the support block 63*a* are accommodated inside the base member 70*a* (inside the box body). At this time, as illustrated by a broken line 94 in FIG. 9, both end surfaces in the X-axis direction of the bottom portion 632*a* accommodated in the inside of the base member 70*a* (inside the box body) come into contact with the inner walls (two hold walls 73) of the base member 70*a*.

The support member 60*a* (the bottom portion 632*a*) is defined in the X-axis direction by coming into contact with the inner walls (two hold walls 73) of the base member 70*a*.

Even with the above configuration, the following effects may be obtained similarly to Embodiment 1.

By moving the intermediary member 80*a* in the −Y direction, the support member 60*a* supporting the transport roller 21 and the base member 70 defining the position of the support member 60*a* may be separated without moving.

Further, by moving the intermediary member 80*a* to separate the support member 60*a* and the base member 70*a*, the support member 60*a* may be easily removed and replaced by utilizing the space resulting from the separation of the intermediary member 80*a*.

Further, when the support member 60*a* is mounted again, by returning the intermediary member 80*a* to the original position (the position between the support member 60*a* and the base member 70*a*), the mounting of the support member 60*a* may be completed easily.

Modified Example 2

Figure 11:
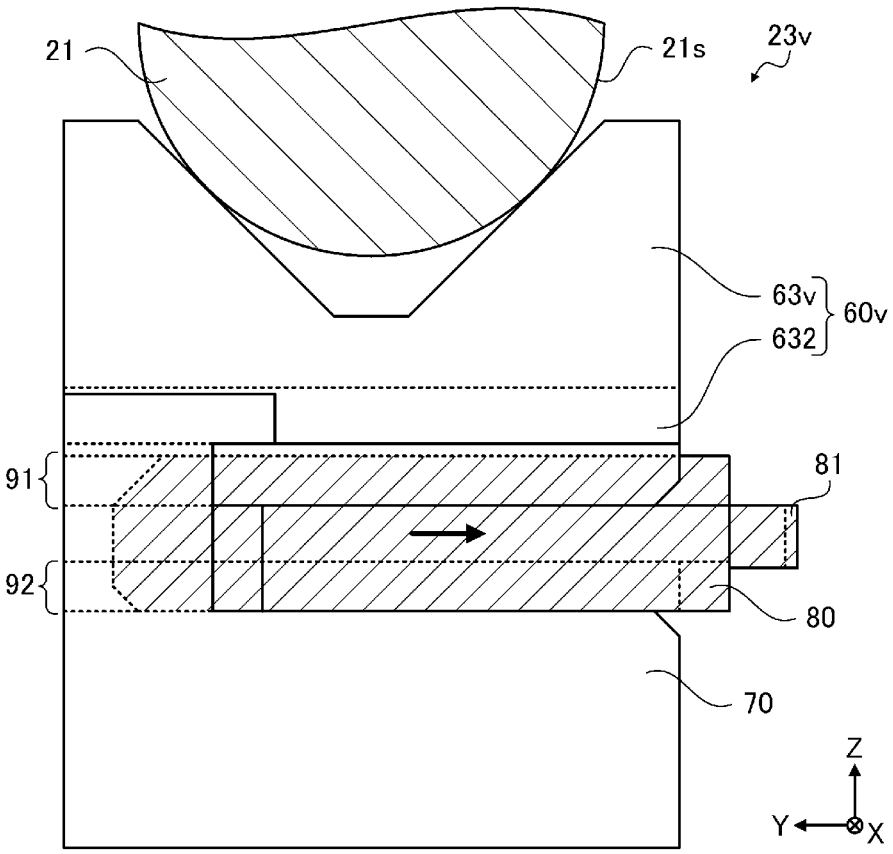
FIG. 11 is a side view illustrating a configuration of a roller support portion as a "support portion" according to Modified Example 2.

FIG. 11 is a side view illustrating a configuration of a roller support portion 23*v* as a "support portion" according to Modified Example 2.

In Embodiment 1, as illustrated in FIG. 3 and FIG. 4, the roller support portion 23 is described as supporting the transport roller 21 by the two bearings 61 in contact with the outer circumferential surface 21*s* of the transport roller 21 at the 2 positions in the circumferential direction, but the configuration of supporting the transport roller 21 is not limited to the configuration using the bearing 61. As illustrated in FIG. 11, the configuration may be a configuration with a block body which contacts and supports the outer circumferential surface 21*s* of the transport roller 21 at two positions in the circumferential direction.

The roller support portion 23*v* includes a support member 60*v* instead of the support member 60 of Embodiment 1. Otherwise, the roller support portion 23*v* has the same configuration as the roller support portion 23.

The support member 60*v* includes a V block body 63*v* which contacts and supports the outer circumferential surface 21*s* of the transport roller 21 at two circumferential positions, and a bottom portion 632.

The V block body 63*v* supports the transport roller 21 in contact with the outer circumferential surface 21*s* of the transport roller 21 at two circumferential positions.

Even with such a configuration, the following effects may be obtained similarly to Embodiment 1.

By moving the intermediary member 80*a* in the −Y direction, the support member 60*v* supporting the transport roller 21 and the base member 70 defining the position of the support member 60*v* may be separated without moving.

Further, by moving the intermediary member 80 to separate the support member 60*v* and the base member 70, the support member 60*v* may be easily removed and replaced by utilizing the space resulting from the separation of the intermediary member 80.

Further, when the support member 60*v* is mounted again, by returning the intermediary member 80 to the original position (the position between the support member 60*v* and the base member 70), the mounting of the support member 60*v* may be completed easily.

Modified Example 3

Figure 12:
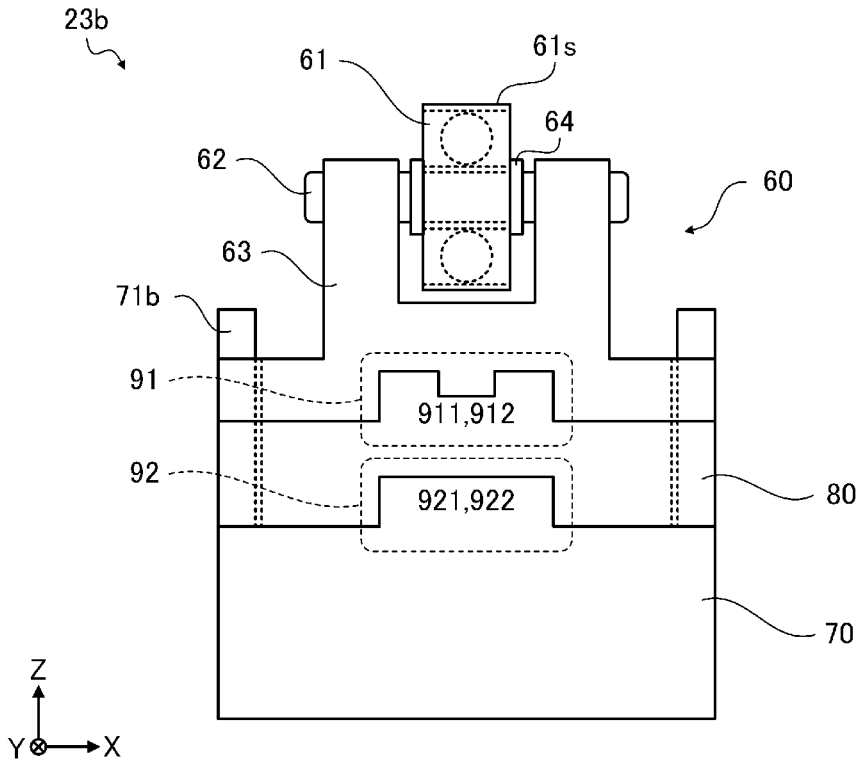
FIG. 12 is a rear view illustrating a configuration of a roller support portion as a "support portion" according to Modified Example 3.

FIG. 12 is a rear view illustrating a configuration of a roller support portion 23*b* as a "support portion" according to Modified Example 3. In addition, in FIG. 12, illustration of the grip portion 81, the tapered portion 66, and the tapered portion 76 is omitted.

In Embodiment 1, as illustrated in FIG. 8, it is described that the groove 911 and the groove 921 are formed at the same position (the same position on the X-axis when the support member 60 and the intermediary member 80 are stacked) on the X-axis in the same shape, and the rib 912 and the rib 922 are formed in the same shape at the same position (the same position on the X-axis when the intermediary member 80 and the base member 70 are stacked) on the X-axis in the same shape, but they do not necessarily have the same shape respectively.

For example, as illustrated in FIG. 12, when the support member 60 and the intermediary member 80 are stacked, in a case in which the groove 911 and the rib 912 are fitted together, and when the intermediary member 80 and the base member 70 are stacked, in a case in which the groove 921 and the rib 922 are fitted together, the groove 911 and the groove 921, as well as the rib 912 and the rib 922 may not have the same shape. Further, these shapes may be such that when the intermediary member 80 is separated and the support member 60 and the base member 70 are stacked on each other, a part (upper region) of the rib 922 fits in the lower region of the groove 911 to form a third regulating structure for regulating the mutual position (position in the X-axis).

Modified Example 4

In Embodiment 1, it has been described that the intermediary member 80 is a spacer member that mediates the support member 60 and the base member 70, and the intermediary member 80 is configured using a polyacetal resin as a suitable example. However, the intermediary member 80 is not limited to such a block body as long as the support member 60 and the base member 70 may be separated without moving.

For example, the intermediary member 80 may be constructed using an elevator mechanism disposed between the support member 60 and the base member 70 and be capable of moving the support member 60 up and down. For example, the elevator mechanism may be driven by compressed air or hydraulic pressure, or by rotationally driving a cam.

Below, contents derived from the embodiments will be described.

A medium transport apparatus of the present application includes a transport roller for transporting a medium, and a support portion for supporting the transport roller. The support portion includes a support member contacting an outer circumferential surface of the transport roller at two positions thereof in a circumferential direction to support the transport roller, a base member defining a position of the support member, and an intermediary member mediating the support member and the base member. The intermediary member may cause separation between the support member and the base member without moving the support member 60 and the base member 70.

According to this configuration, the support portion supporting the transport roller includes a support member which contacts an outer circumferential surface of the transport roller at two positions in a circumferential direction to support the transport roller, a base member which defines the position of the support member, and an intermediary member which mediates the support member and the base member, and the intermediary member may separate the support member and the base member without moving the support member 60 and the base member 70. In other words, since the roller support portion supporting the transport roller has a separated structure in which the intermediary member is interposed, by moving the intermediary member without moving the support member supporting the transport roller and the base member defining the position of the support member, the support member and the base member may be separated.

Further, by moving the intermediary member to separate the support member and the base member, the support member may be easily removed and replaced by utilizing the space resulting from the separation of the intermediary member. Specifically, since the support member is configured to contact and support the outer circumferential surface of the transport roller at two circumferential positions, the support member may not be caused to move (without moving the transport roller) in the straight line direction connecting the contact points which contact with the outer circumferential surface. On the other hand, since the support member may be moved in the direction of the space resulting from the separation of the intermediary member, the support member may be more easily removed and replaced.

Further, when the support member is mounted again, by returning the intermediary member to the original position (the original position in the positional relationship with the support member and the base member respectively), the mounting of the support member may be completed easily. In the configuration in which the intermediary member is stacked between the support member and the base member in the height direction, by inserting and returning the intermediary member between the support member and the base member, the positional relationship between the support member and the base member in the height direction may be reproduced.

In the above medium transport apparatus, the support member and the intermediary member may have a first regulating structure for regulating the mutual position, and the intermediary member and the base member may have a second regulating structure for regulating the mutual position.

According to this configuration, the support member and the intermediary member include the first regulating structure for regulating the mutual position, and further the intermediary member and the base member include the second regulating structure for regulating the mutual position. That is, the position of the support member supporting the transport roller is defined by the base member defining the position of the support member via the intermediary member (via the first regulating structure and the second regulating structure). In the configuration in which the intermediary member is stacked between the support member and the base member in the height direction, by inserting and returning the intermediary member between the support member and the base member, the position in the direction defined via the first regulating structure and the second regulating structure in addition to the positional relationship in the height direction between the support member and the base member may be reproduced. That is, it is not necessary to adjust the position each time the support member is exchanged.

In the medium transport apparatus described above, the intermediary member may be separated from the support member and the base member by moving along the predetermined direction, and the first regulating structure and the second regulating structure may regulate the positions respectively in the direction intersecting the predetermined direction.

According to this configuration, the intermediary member may be separated from the support member and the base member by moving along the predetermined direction, and the first regulating structure and the second regulating structure regulate the position in the direction intersecting the predetermined direction. That is, the direction, regulated by the first regulating structure for regulating the positional relationship between the support member and the intermediary member and the second regulating structure for regulating the positional relationship between the intermediary member and the base member, intersects the predetermined direction in which the intermediary member is moved to be separated from the support member and the base member. Therefore, the first and second regulating structures do not interfere with the movement of the intermediary member from the support member and the base member, so that the support member, the base member, and the intermediary member may be easily separated.

In the medium transport apparatus described above, the support member and the base member may have a third regulating structure for regulating the mutual position when the support member and the base member are stacked on each other.

According to this configuration, the support member and the base member include the third regulating structure for regulating the mutual position when the support member and the base member are stacked on each other. In other words, when the intermediary member is separated from the support member and the base member, and the support member and the base member are stacked, the movement of the support member in the direction, which is regulated by the third regulating structure, may be regulated with respect to the base member which defines the position of the support member. For example, when the position, at which the support member is regulated with respect to the base member in the direction regulated by the first regulating structure and the second regulating structure, is set the same as the position at which the support member is regulated with respect to the base member in the direction regulated by the third regulating structure, the degree of adjustment of the position of the support member when returning the intermediary member to the original position may be reduced.

In the medium transport apparatus, the first to third regulating structures may have a shape in common.

According to this configuration, since the first regulating structure, the second regulating structure, and the third regulating structure have a common shape respectively, the regulation of the positional relationship between the support member and the base member and the regulation of the positional relationship between the support member and the intermediary member, and the regulation of the positional relationship between the base member and the intermediary member, may be performed in the same manner.

In addition, by setting the dimensional position in the regulating direction of the first to third regulating structures the same, the position in which the support member is regulated relative to the base member in the direction regulated by the first and the second regulating structures, and the position in which the support member is regulated relative to the base member in the direction regulated by the third regulating structure, may be set at the same position.

In the medium transport apparatus, at least one of the support member and the base member may include an insertion portion into which an end portion of the intermediary member in the direction opposite to the predetermined direction is inserted when the support member and the base member are stacked on each other.

According to this configuration, at least one of the support member and the base member includes an insertion portion into which an end portion of the intermediary member in the direction opposite to the predetermined direction is inserted when the support member and the base member are stacked on each other. Therefore, when the intermediary member is separated from the support member and the base member and is then inserted again between the support member and the base member to return the intermediary member to the original position, the operation above may be facilitated.

In the medium transport apparatus, the intermediary member may include a grip portion at the end portion in the predetermined direction.

According to this configuration, since the intermediary member includes the grip portion at the end in the predetermined direction, an operation of moving the intermediary member along the predetermined direction and separating it from the support member and the base member, may be facilitated.

The printing apparatus of the present application includes the medium transport apparatus described above.

According to this configuration, since the printing apparatus includes the medium transport apparatus which facilitates removal/replacement of the support member which supports the transport roller for transporting the medium, the reduction in productivity due to replacement of the support member may be suppressed.

What is claimed is:

1. A medium transport apparatus comprising:

a transport roller configured to transport a medium; and a support portion configured to support the transport roller, wherein the support portion includes a support member contacting an outer circumferential surface of the transport roller at two positions thereof in a circumferential direction to support the transport roller, a base member defining a position of the support member, and an intermediary member mediating the support member and the base member, and the intermediary member is configured to cause separation between the support member and the base member without moving the support member and the base member.

2. The medium transport apparatus according to claim 1, wherein the support member and the intermediary member include a first regulating structure configured to regulate a mutual position thereof, and the intermediary member and the base member include a second regulating structure configured to regulate a mutual position thereof.

3. The medium transport apparatus according to claim 2, wherein the intermediary member is configured to be separated from the support member and the base member by moving along a predetermined direction and the first regulating structure and the second regulating structure regulate positions in a direction intersecting the predetermined direction.

4. The medium transport apparatus according to claim 3, wherein at least one of the support member and the base member includes an insertion portion into which an end portion of the intermediary member in a direction opposite to the predetermined direction is inserted when the support member and the base member are stacked on each other.

5. The medium transport apparatus according to claim 3, wherein the intermediary member includes a grip portion at an end portion thereof in the predetermined direction.

6. The medium transport apparatus according to claim 2, wherein the support member and the base member include a third regulating structure configured to regulate a mutual position thereof when the support member and the base member are stacked on each other.

7. The medium transport apparatus according to claim 6, wherein the first to third regulating structures have a shape in common.

8. A printing apparatus comprising the medium transport apparatus according to claim 1.

* * * * *